US010501956B2

(12) United States Patent
Marek

(10) Patent No.: US 10,501,956 B2
(45) Date of Patent: Dec. 10, 2019

(54) HURRICANE, TORNADO, FLOOD, STORM SURGE, FOREST FIRE AND MUD SLIDE RESISTANT HOUSE

(71) Applicant: MAE Housing, Inc., Wilmington, DE (US)

(72) Inventor: Lawrence Marek, New York, NY (US)

(73) Assignee: MAE Housing, Inc., Wilmington, DE (US)

( * ) Notice: Subject to any disclaimer, the term of this patent is extended or adjusted under 35 U.S.C. 154(b) by 0 days.

(21) Appl. No.: 16/041,409

(22) Filed: Jul. 20, 2018

(65) Prior Publication Data

US 2018/0328068 A1 Nov. 15, 2018

Related U.S. Application Data

(63) Continuation of application No. 14/822,102, filed on Aug. 10, 2015, now abandoned.

(51) Int. Cl.
*E04H 9/02* (2006.01)
*E04H 9/14* (2006.01)

(52) U.S. Cl.
CPC ..... *E04H 9/028* (2013.01); *E04H 9/14* (2013.01)

(58) Field of Classification Search
CPC .... E04H 9/21; E04H 9/27; E04H 9/28; E04B 2/86; E04B 2002/8688
See application file for complete search history.

(56) References Cited

U.S. PATENT DOCUMENTS

| | | | |
|---|---|---|---|
| 1,706,496 | A | 3/1929 | Pieri |
| 2,053,226 | A | 9/1936 | Ruge |
| 2,510,958 | A | 6/1950 | Coff |
| 3,129,531 | A | 4/1964 | Connor |
| 3,158,959 | A | 12/1964 | Ratliff |
| 3,418,768 | A | 12/1968 | Cardan |
| 3,432,978 | A | 3/1969 | Erickson |

(Continued)

FOREIGN PATENT DOCUMENTS

| | | | |
|---|---|---|---|
| CA | 2180302 | A1 | 1/1998 |
| EP | 0857834 | A1 | 7/2003 |

(Continued)

*Primary Examiner* — Christine T Cajilig
(74) *Attorney, Agent, or Firm* — Henry J. Cittone; Cittone Demers & Arneri LLP

(57) ABSTRACT

Embodiments of the present invention provides a unique building structure, and a method to manufacture such building structure that may be able to withstand powerful forces of nature and extreme weather conditions, such as hurricanes, tornado, flood storm, high speed winds, forest fire, mud slide, tsunami, heavy snow, and the like. The building structure may comprise of a concrete anchor unit to which an assembly of structural compression modules and horizontal and vertical tension elements may be attached. The assembly of compression modules and tension elements effectively transfers the natural forces acting along the building structure, thereby resisting the forces by the tension elements. The building structure may be independent of foundation and can be placed anywhere there is solid bearing material that will support its weight. Further, the present invention aims at providing the unique building structure and the manufacturing method at competitive pricing rates.

10 Claims, 8 Drawing Sheets

(56) References Cited

U.S. PATENT DOCUMENTS

| | | | |
|---|---|---|---|
| 3,477,183 | A | 11/1969 | Graham |
| 3,712,010 | A | 1/1973 | Porter |
| 3,735,549 | A | 5/1973 | Shuart |
| 3,796,017 | A | 3/1974 | Meckler |
| 3,869,836 | A | 3/1975 | Allen |
| 4,065,218 | A | 12/1977 | Biggane |
| 4,065,907 | A | 1/1978 | Rice |
| 4,125,978 | A | 11/1978 | Schildge, Jr. |
| 4,126,972 | A | 11/1978 | Silen |
| 4,223,506 | A | 9/1980 | Blair |
| 4,441,289 | A | 4/1984 | Ikuo |
| 4,860,507 | A | 8/1989 | Garza-Tamez |
| 4,907,384 | A | 3/1990 | Underwood |
| 5,950,374 | A | 9/1999 | Gromat |
| 5,966,877 | A | 10/1999 | Hawes |
| 6,014,843 | A | 1/2000 | Crumley |
| 6,185,898 | B1 | 2/2001 | Pratt |
| 6,843,027 | B2 | 1/2005 | Gaddie |
| 7,784,223 | B1 | 8/2010 | Ramey |
| 8,800,232 | B1 | 8/2014 | Keenan |
| 9,316,012 | B2 | 4/2016 | Perry |
| 9,333,672 | B1 | 5/2016 | Gavish |
| 2001/0032420 | A1 | 10/2001 | Chen |
| 2003/0200706 | A1 | 10/2003 | Kahan |
| 2007/0220817 | A1 | 9/2007 | Bonds |
| 2008/0229684 | A1 | 9/2008 | Joung |
| 2009/0025307 | A1 | 1/2009 | Crichlow |
| 2009/0025312 | A1 | 1/2009 | Deans |
| 2011/0030288 | A1 | 2/2011 | Traulsen |
| 2012/0167490 | A1 | 7/2012 | Balducci |
| 2013/0031857 | A1 | 2/2013 | Tincher |
| 2013/0145702 | A1 | 6/2013 | Oba |
| 2014/0001577 | A1 | 1/2014 | Liu |
| 2015/0191928 | A1 | 7/2015 | Germain |
| 2017/0009477 | A1* | 1/2017 | Konishi ..... E04G 23/02 |

FOREIGN PATENT DOCUMENTS

| | | | |
|---|---|---|---|
| FR | 3019198 | B1 | 3/2014 |
| WO | 2015069059 | A1 | 5/2015 |

* cited by examiner

FIG. 1A
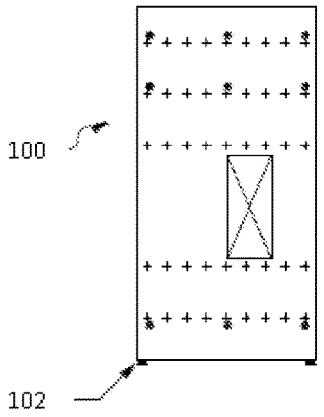
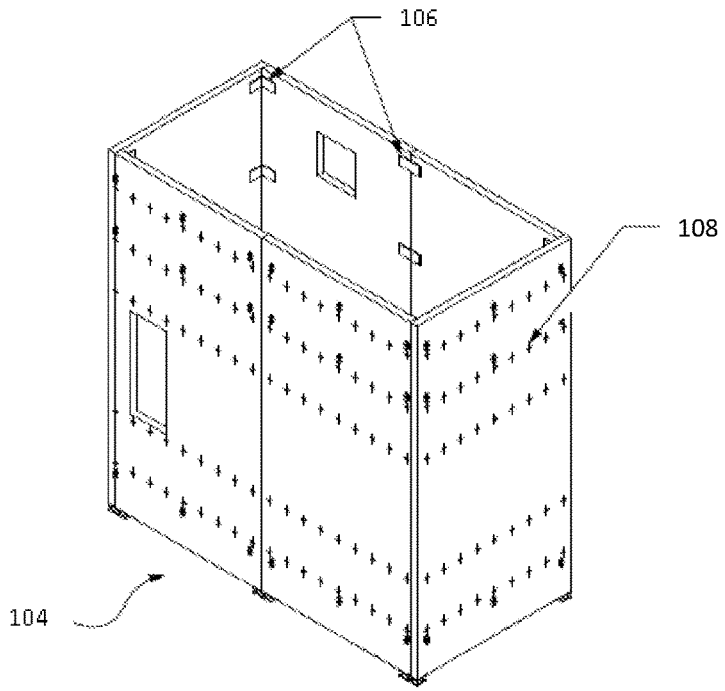
FIG. 1B

HURRICANE, TORNADO, FLOOD, STORM SURGE, FOREST FIRE AND MUD SLIDE RESISTANT HOUSE

CROSS-REFERENCE TO RELATED APPLICATIONS

This application claims benefit of U.S. patent application Ser. No. 14/822,102 filed Aug. 10, 2015, the disclosure of which is hereby incorporated by reference in its entirety.

FIELD OF THE INVENTION

The present invention generally relates to a building facility that provides resistance to the extreme natural forces. More particularly, the present invention relates to manufacturing a building facility resistant to natural forces using manufacturing methods developed in the automotive, aerospace and suspension bridge industries, combined with current concrete and wire rope technology.

BACKGROUND OF INVENTION

Loss of life and property occur in a natural disaster when the fabric of a dwelling in which humans are sheltered fails when subjected to the extraordinary forces of an uncommonly occurring event of nature. Until now, attempts to bolster the robustness of the standard wood stick framed house have been inadequate, as the dollar value of construction lost in the last decade, to severe storms, shows.

It is well known that high speed wind can do great damage to residential and commercial building structures, particularly in areas prone to hurricanes and other high wind storms. Each year hurricanes cause a considerable amount of damage to buildings, resulting in increased insurance rates. For this reason several states have enacted new building codes designed to insure that new structures are resistant to hurricane speed winds. For example, the state of Florida recently enacted a new building code which requires all new buildings to comply with standards by the American Society of Civil Engineers and the Southern Building Code.

In the United States, wood structures have been predominant in constructing houses of every size. Such structures may be utilized in residential and light commercial construction. When wood framing is employed, the structure must be protected from upward, shear and overturning loads developed by either wind or seismic activity which differs with geographical location. Other than such natural forces, the wood framed structures should also be resistant to other weather conditions such as, water, temperature, snow, and the like. Such wood structures may need a resistant coating. Each year hurricanes and high speed winds cause considerable destruction to wood framed buildings, and greatly devalue the money invested in constructing these buildings. For these reasons, many design codes for buildings have been introduced to insure new building structures are resistant to powerful natural forces. However, building houses or other structures by implementing such codes and techniques is a costly affair.

It is a scientific fact that the severity of natural processes; storms, winds, tsunamis and other natural phenomenon; are going to increase in severity in the coming decades due to climate change. The present state of the building stock in the United States, particularly single family housing, is woefully unprepared for this coming increase in storms. A study concentrating on a strip of land ten miles wide; extending back from the mean high water line, running from Maine to Mexico, following the coast of the Continental US; reports that in that small band alone there are 1.4 trillion dollars worth of buildings at risk.

Therefore, there exists a need to provide a unique building structure and housing assembly that can withstand extremely powerful natural forces and weather conditions capable of damaging the housing structures, and a method to build that assembly. Further, there also exists a need to produce and erect this building structure and housing assembly at a competitive price.

SUMMARY OF INVENTION

Therefore, in light of the above needs and requirements, the present invention provides a building facility, including commercial building, a single or two family housing that can resist the forces of nature and remain intact and standing after the passage of a natural disaster and a method to manufacture and build the same. The present invention described herein addresses the above mentioned problems by the creation of a dwelling based on automotive manufacturing technology, using materials and processes that use non-combustible or thermally protected materials assembled from identical manufactured parts that form a house that is several orders of magnitude stronger than the conventional structure of today.

Further, the present invention provides a unique building structure that will withstand the onslaught of a hurricane, tornado, storm surge, flood, mud slide or wild fire. Fabrication is accomplished by the adaptation of manufacturing techniques from the automotive industry to fabricate components that are combined into a unique structural assembly composed of compression members and steel cables in tension that, in the aggregate, will produce a building that is much stronger and more resilient than the kind of wood frame houses that are now the norm in the United States. Because of the adaptation of automotive manufacturing techniques, the building structure will be able to be produced and erected at a price that will be competitive with the existing market price points.

An objective of the present invention is to provide a unique building structure that can withstand powerful natural disasters and weather conditions, such as hurricane, tornado, flood, storm surge, forest fire and mud slide resistant house.

Another objective of the present invention is to provide a method to construct a unique building structure that can withstand powerful natural disasters and weather conditions, such as hurricanes, tornados, floods, storm surges, forest fires and mud slides.

A further objective of the present invention is to build said unique building structure at competitive price rates.

A yet further objective of the present invention is to provide a building facility whose components are lighter, resulting in lower manufacturing costs and much easier manipulation and erection on the jobsite.

BRIEF DESCRIPTION OF DRAWINGS

FIG. 1A illustrates a concrete panel that may be utilized in forming a concrete anchoring unit, in accordance with an embodiment of the present invention.

FIG. 1B illustrates a three dimensional view of a concrete anchoring unit that acts as an anchor to which a unique building structure is attached, in accordance with an embodiment of the present invention.

DETAILED DESCRIPTION OF EMBODIMENTS

Figure 2A:
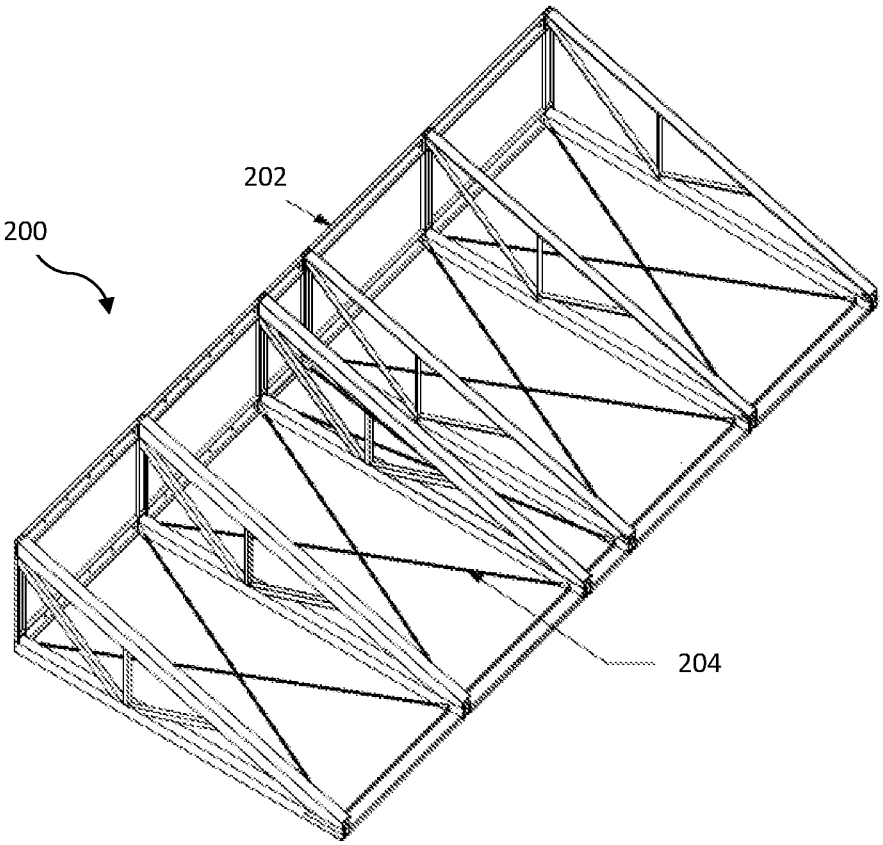
FIG. 2A shows a structural compression module that may be attached to a concrete anchoring unit for building a structural assembly, in accordance with an embodiment of the present invention.

In the following detailed description of embodiments of the invention, numerous specific details are set forth in order to provide a thorough understanding of the embodiment of invention. However, it will be obvious to a person skilled in art that the embodiments of invention may be practiced with or without these specific details. In other instances well known methods, procedures and components have not been described in detail so as not to unnecessarily obscure aspects of the embodiments of the invention.

Furthermore, it will be clear that the invention is not limited to these embodiments only. Numerous modifications, changes, variations, substitutions and equivalents will be apparent to those skilled in the art, without parting from the spirit and scope of the invention.

The present invention provides a unique building structure, such as a housing facility, that may be able to withstand the powerful forces of nature, such as high speed winds of hurricanes, tornado, and the like, and a method to build the same. Further, the present invention aids in manufacturing building structures using manufacturing methods adapted from the automotive industry, combined with concrete and tensioned steel cables. The building manufactured by such technology provided in the present invention may be capable of resisting the extreme forces of nature that future climate change will intensify. The building structure is composed of a unique structural assembly that will give it strength and rigidity far in excess of the current home building technology that consists of constructing with a myriad of small wooden members.

The building structure provides a structural assembly for facilities like housing, commercial buildings, and other buildings. It comprises a concrete anchoring unit, a plurality of compression modules, and a plurality of tension elements, all of which may be formed from manufactured components. All of these aforementioned components are arranged in a manner such that they produce a building able to withstand extreme natural forces. In embodiments of the present invention, the compression module may be formed by welding steel sections or steel bars together using robotic welding processes. The steel sections may be welded such that they form a truss, hence producing a compression module. Further, the weight of the truss in the compression module, comprising the steel sections, may be distributed and hence, lessened using tension elements. In an embodiment, the tension elements may be steel cables providing tension forces in the compression module. The tension elements may be installed in the horizontal plane of the structural compression module, acting in tension to reduce the weight of the steel sections required by lessening the strength needed in the moment connections or other connections between steel elements.

Therefore, embodiments of the present invention provide a unique building structure comprising of concrete anchoring member, structural compression modules, and tension elements.

Referring now to FIG. 1A, a concrete panel 100 that may be utilized in forming a concrete anchoring unit, in accordance with an embodiment of the present invention as described herein. The concrete panel 100 may be manufactured and delivered to the construction site or can be poured on site. A number of concrete panels 100 may be assembled together to form a rectangular concrete anchoring unit (as is shown in FIG. 1B) with required dimensions. The concrete panel 100 may have a plurality of leveling jacks 102 at its bearing points to provide adjustment provisions for other concrete panels to connect and lock with each other at different levels. In an embodiment, as shown in the FIG. 1A, the concrete panel 100 has two leveling jacks 102. In an embodiment of the present invention, the concrete panel 100 may measure 12' by 24'×8".

FIG. 1B illustrates a three dimensional view of a concrete anchoring unit that acts as an anchor to which a unique building structure is attached, in accordance with an embodiment of the present invention. According to embodiments of the present invention, a building facility may be anchored to a concrete anchoring unit 104 that may be further built by assembling a required number of concrete panels 100 together. The concrete anchoring unit 104 may be in the form a box, rectangular, or square, depending on the requirements.

In embodiments of the present invention, for producing a concrete anchoring unit 104, the concrete panels 100 may be held together by steel clips 106 that are bolted into inserts that are cast into the concrete panel 100 as in steel clips 106 and leveling jacks 102. According to an embodiment of the present invention, FIG. 1B shows the reinforced concrete panels 100, measuring approximately 12' by 24'×8", assembled into a rectangle concrete anchoring unit 104 that measures 12' by 24' in plan and 24' high.

For erecting a building facility, one or more structural compression modules installed with a one or more tension elements may be attached to the concrete anchoring unit 104. Preferably, for easily workability of this, in embodiments, the concrete panels 100 of the concrete unit 104 may be provided with inserts 108 at a number of locations of concrete panels 100. The inserts 108 allow for easy fastening installation of the compression modules with the concrete unit 104. Further, these inserts 108 may be preinstalled on the concrete panels 100 when manufactured. The structural compression modules with tension elements are described later in following figures.

FIG. 2A shows structural compression module that may be attached to a concrete anchoring unit for building a structural assembly, in accordance with an embodiment of the present invention. The structural compression module 200 may be a truss welded from standard steel sections 202, using the robotic welding process that is common within the manufacturing sector today. A number of steel sections 202 may be welded to form a truss, depending upon the size and weight of the compression module 200. The structural compression module 200 is the most basic unit for building the housing facility as provided by embodiments of the present invention. In embodiments of the present invention, because each type of structural compression module 200 is exactly the same as the others of its type, they may be set up to be welded, precisely drilled to receive various types of fasteners required and manufactured in an assembly line setting, preferably an automated assembly line which may utilize robots.

Further, the compression module 200 may be installed with a required number of horizontal tension elements 204 for distributing the weight forces of the compression modules 200, and hence, lessening the weight possessed by the compression modules 200. Therefore, due to the installment of the tension elements 204, the weight of the steel sections 202 in the compression module 200 may be reduced.

Still further, the horizontal tension elements 204 may be installed diagonally across the structural compression module 200. The diagonal tension elements 204 may be installed in the manufacturing facility so that the only assembly of the tension system required in the field will be to connect the vertical upper slanted tension elements (described later in following figures) to the structural compression modules 200.

An alternate method of producing the compression modules 200 that is new technology and has recently passed the proof of concept stage is 3-D printing of the compression module 200 by using 15% carbon fiber reinforced ABS plastic with steel inserts at the points of maximum stress.

As mentioned above in conjunction with FIG. 1B, for manufacturing a building facility, a required number of structural compression modules 200 along with horizontal tension elements 204 may be attached to the concrete anchoring unit 104. Further, each concrete panel 100 may also contain threaded embedments for the purpose of attaching the structural compression modules 200 and the tension elements 204, preferably a steel cable. This is true whether all of the structural compression modules possible are used at the initial erection of a structure or not. In this way, if a structure owner desires to enlarge their structure at a later date, he/she simply has to purchase additional structural compression modules 200 and bolt them to the original configuration resulting into a larger structure.

In an embodiment, the concrete anchoring unit 104 may be configured with a complete kitchen and full bathroom with a sleeping loft. They may be designed as plug in modules with ability to upgrade from the basic housing unit at any time in the future. All necessary plumbing and electrical systems will be factory installed.

Figure 2B:
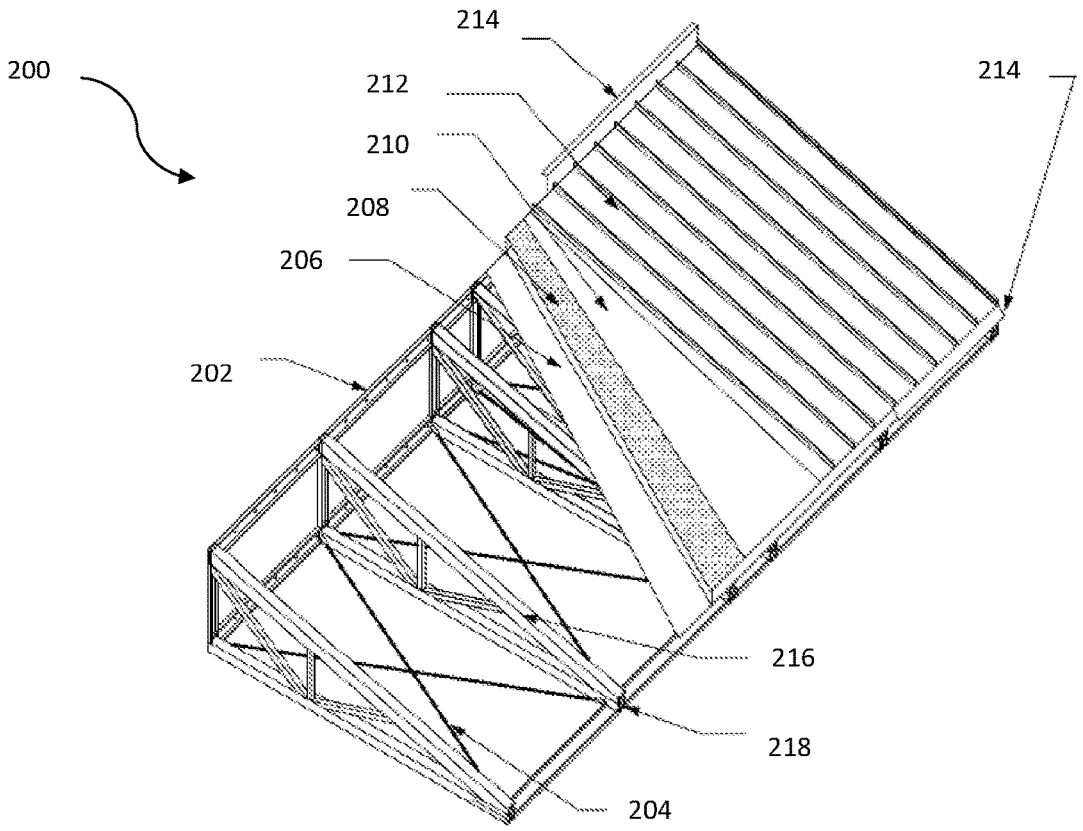
FIG. 2B shows a structural compression module, with exterior weathering surface, in accordance with an embodiment of the present invention.

FIG. 2B shows a typical structural compression module, with exterior weathering surface, in accordance with an embodiment of the present invention. The compression module 200 as shown in FIG. 2B is preferably provided in completed form and may be shipped from a manufacturing facility. Further, as an objective of the present invention to provide a resistant coating to the building facility for protecting the building from weather conditions, the compression modules 200 may be provided with an exterior weathering surface. The exterior weathering surface may be installed (shown partially cut away for clarity), consisting of a deck 206 that may be further screwed to the structural compression module 200. The deck 206 may be made of non-combustible materials, such as steel, ceramics and the like, providing protection against fire. Furthermore, the exterior weathering surface may consist of a closed cell rigid insulation or other insulation 208 above the deck 206. Preferably, the insulation 208 provides resistance against an extreme natural force, such as forest fire, lightning, rain water, and the like, and protects from any damages caused to the interior of the building facility. In an embodiment, the cell rigid insulation 208 may be 6 inches or more in width.

In further embodiments, a seamless waterproofing membrane 210 may be present above the cell rigid insulation 208, further providing a provision for resisting water penetration through the weathering surface. After getting all the layers of weathering surface in place, a standing seam metal roof 212 may be screwed through the cell rigid insulation 210 to the non-combustible deck 206 with a type and number of fasteners required to maintain the integrity of the weathering surface roof under high wind forces. Therefore, a strong and resistant coating may be achieved that efficiently keeps the damaging weather conditions from the building facility.

The compression module 200 may also be shipped, from a manufacturing unit, with integral flashing systems 214 at the top to tie into the concrete anchoring unit 104 and at the eave to lap over the vertical wall panels. Also, the compression modules 200 may be delivered from a manufacturing facility with all external weather tight surfaces installed.

Further, some of the steel sections 202 of the compression module 200, such as the steel sections 216 may be hollow in structure for allowing the tension elements 204 to be placed in an inner space, for example at an angle. Therefore, the hollow steel sections 218 may take tension elements 204 in the interior further providing a provision for developing tension in the truss formed in the compression module 200. Furthermore, the compression module 200 may also have a roller bearing pulley 220 installed at one end of the hollow steel sections 218 for adjusting the tensile forces generated by compression, expansion, or deformation of the steel sections of the compression module 200.

Figure 3A:
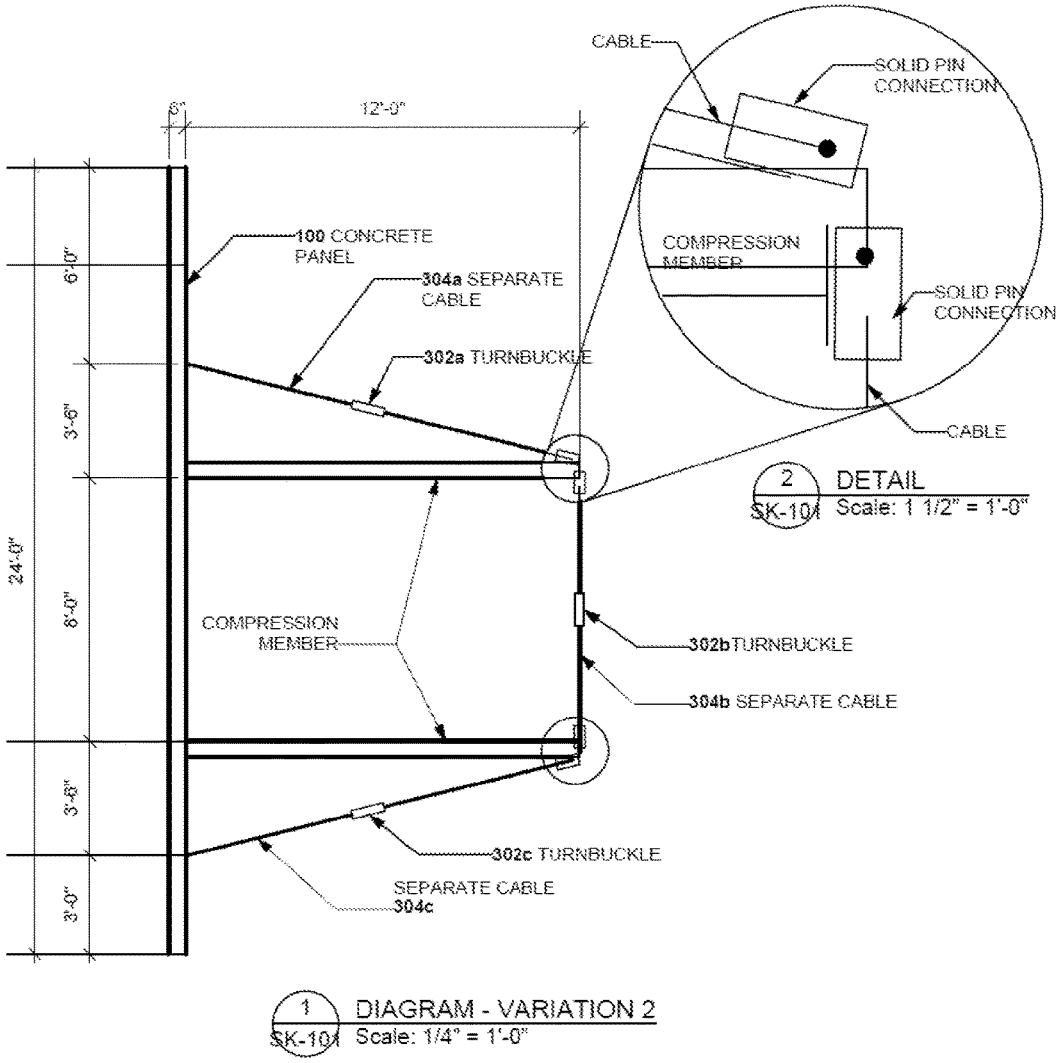
FIGS. 3A and 3B show two force diagrams in the plane of the tension elements, in accordance with an embodiment of the present invention.
Figure 3B:
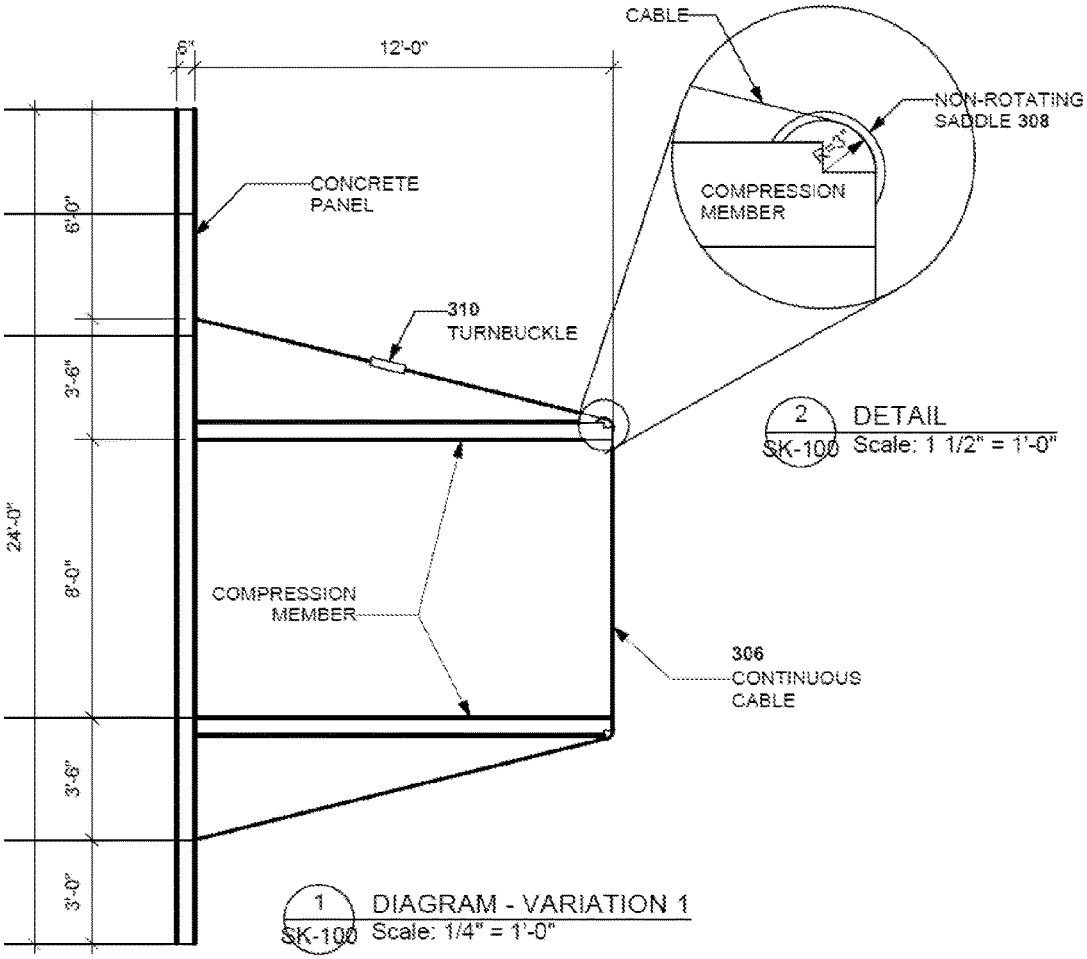

FIGS. 3A and 3B show two force diagrams in the plane of the tension elements, in accordance with an embodiment of the present invention. The distribution and transfer of forces play a crucial role in maintaining the building assembly, under powerful natural forces. The tension elements 304(*a-c*) may preferably be steel cables. The tension elements 304(*a-c*) that are installed in the compression module 200 (See FIG. 2) are preferably strong in tension and weak in compression. Further, the tension elements 304(*a-c*) may be stood out from the concrete anchor unit 104 (See FIG. 1) by the compression module 200, staying in continuous tension by adjustment of the tension at a turnbuckle 302*a*, 302*b* installed during the manufacturing process. A required number of turnbuckles may be installed in the tension elements 304(*a-c*) depending on the size and weight of the compression module 200. The arrangement of turnbuckles (302*a*, 302*b*) and the tension elements (304(*a-c*)) in the compression module 200 enables the building structure to resist massive loads in the plane of the tension elements 304(*a-c*), i.e., up, down and outwardly in the plane of the tension elements assembly.

Tension elements, such as steel cables, may also be installed in the horizontal plane of the compression module 200, acting in tension to reduce the weight of the steel sections 202 required by lessening the strength needed in the moment connections or other connections between steel sections 202. This further allows the compression module 200 to resist the tension forces in its horizontal plane with lighter steel sections 202, thus making the compression modules 200 easier to transport and handle on the construction site because of their lighter weight. The tension elements are shown earlier in FIG. 2. In an embodiment, preferably, like the concrete anchor unit 104, the structural compression modules 200 are all predrilled at the manufacturing site to take all the possible components that can be added, thus also facilitating the simple expansion of a structure in the future after the initial erection.

FIG. 3A depicts a force diagram for tension elements in the compression module 200 installed with turnbuckles, where the cable assembly including separate tension cables 304 are utilized. This further means that the separate tension cables 304 are connected through a solid pin connection at the vertex of the truss compression module 200. The tension in the cables 304*a*, 304*b*, and 304*c* are adjusted at separate turnbuckles 302*a*, 302*b*, and 302*c* that are installed for each cable respectively. FIG. 3B depicts a force diagram for tension elements in the compression module 200 installed with turnbuckles, where the cable assembly including a single continuous tension cable 306 is utilized. The single continuous cable 306 slides over a non-rotating saddle 308, and may be provided with one turnbuckle 310 for adjusting tensile forces acting along the tension cable 306.

Figure 4:
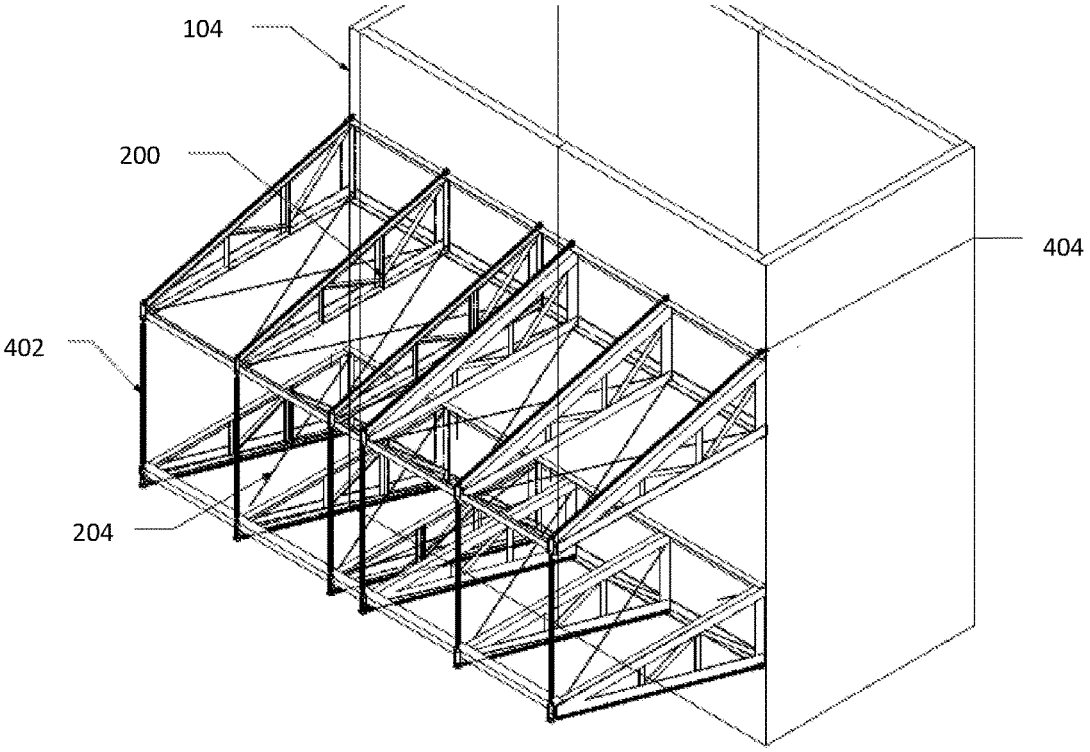
FIG. 4 shows a structural assembly to build a building facility, in accordance with an embodiment of the present invention.

FIG. 4 shows a basic unique structural assembly required to build a building facility, in accordance with an embodiment of the present invention. The building structure must have the minimum of the components shown in FIG. 4. To reiterate, these may be the concrete anchor 104, a minimum of two structural compression modules 200, with horizontal tension elements 204 preinstalled, and a minimum of six cable assemblies 402 in vertical and diagonal configuration shown. The configuration shown in FIG. 4 represents an exemplary minimum basic "house" or building structure. The structure may be enlarged by the addition of two compression modules 200 and a number of cable elements 404 that anchor into the concrete panels. The next enlargement is achieved by the addition of the same number of compression modules 200 and cable elements 402, 404 as shown in the FIG. 4. The additional compression module 200 is preferably contiguous with the first one.

In an embodiment, the vertical tension cables 402 and the cables 404 that anchor into the concrete anchoring unit 104 may be separate from each other (as shown earlier in FIG. 3A). In another embodiment, the vertical tension cables 402 and the cables 404 may be one single tension cable sliding over a saddle, as described earlier in FIG. 3B.

Referring now to FIGS. 3A and 3B, the turnbuckles (302, 310) allow the structural assembly to be fine tuned after initial erection, allowing a required tension force to be imparted to the structural assembly. This enables the structural assembly to be adaptable to different design criteria, depending on its location and situation. Furthermore, this also allows for greater economy by enabling an individual building, either a house, a commercial property, and the like, to be tailored to its expected external forces without change in components.

Figure 5:
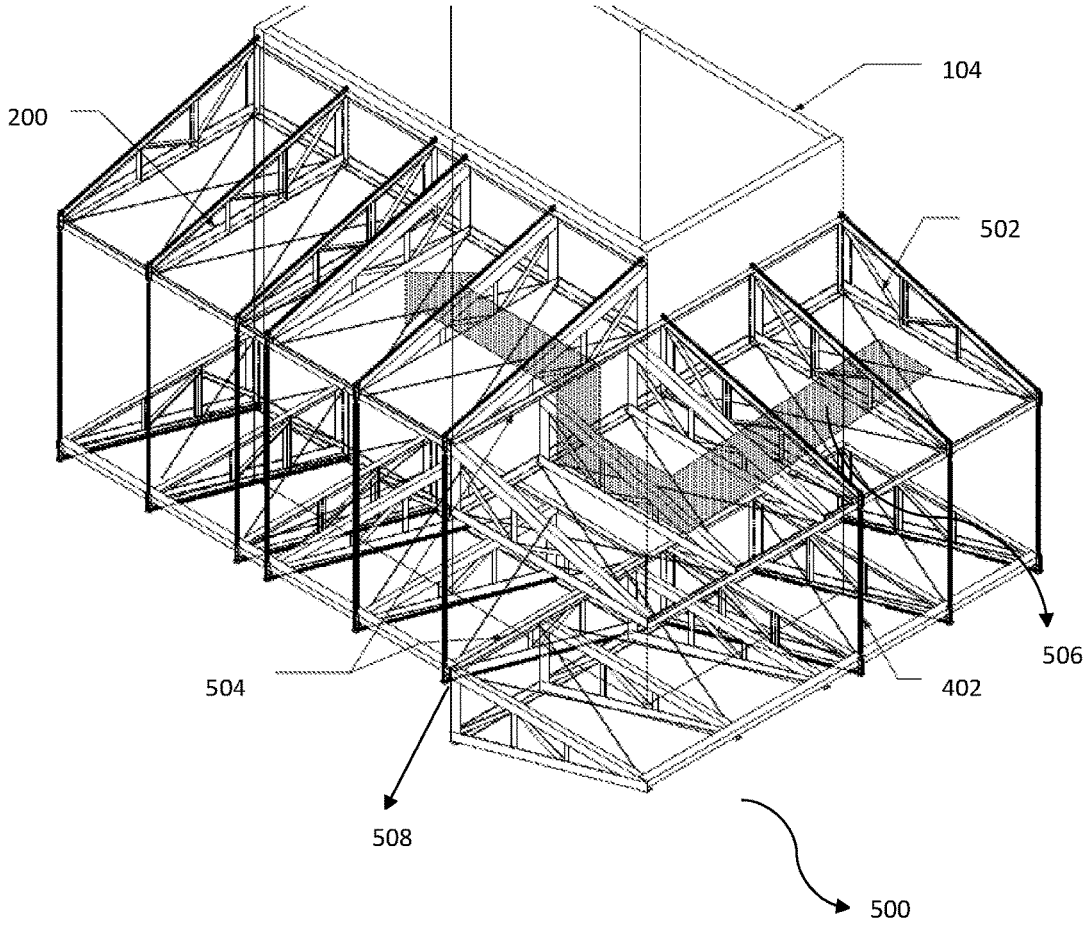
FIG. 5 shows an expanded structural assembly and how the structural compression modules transfers forces in accordance with an embodiment of the present invention.

Referring to FIG. 5, it shows the second possible enlargement of the unique structural assembly, along with showing how the structural compression modules transfer the horizontal forces acting from any direction, in accordance with an embodiment of the present invention. The housing structure 500 shown in FIG. 5 may be built by the addition of two more compression modules 200 and six more vertical tension members 402 and 404.

FIG. 5 also illustrates a horizontal force 506 acting at ninety degrees around the concrete panels 100 of the concrete anchoring unit 104, in an embodiment of the invention. The structural assembly 500 shown in the FIG. 5 may efficiently resist powerful natural forces acting along any direction of the structural assembly 500. The forces are resisted by the tension cables installed in the compression modules 200. A key to this effect is the "stitching" of two compression modules 200 together with high strength bolts along the line where the two horizontal members meet at the corner of the concrete anchor unit. This "stitching" is called out in the FIG. 5. The reason that this transfer of horizontal forces is important is, since the cables 204 are very strong in tension with respect to their weight and volume, by transferring the forces to the cables, the compression module can be designed to be strong in the horizontal plane direction that stands off the tension cables 204 and will not have to be as strong in the vertical direction and not as strong in the angled plane. This results in a lighter structure that will further result in lower manufacturing costs and much easier manipulation and erection on the jobsite. FIG. 5 shows the two structural compression modules 200 offset, at 508, vertically by the depth of one compression module, thus achieving a higher ceiling under the elevated module, according to an embodiment.

Conceivably all of the structural compression modules 200 could be raised to the higher position. According to an embodiment shown in FIG. 5, the ceilings in the modules would be 8'-0". This is a present US de facto industry standard and would allow on the exterior paneling and interior finishes, the ability to take advantage of existing materials in order to keep the unit within a competitive price range. This does not obviate placing all of the structural compression modules 200 at the higher position and creating an out of standard, luxury unit.

Further, FIG. 5 shows compression trusses 502 of the compression modules 200 bolted to the concrete anchoring unit 104. At the top and bottom of the structural assembly 500, the compression trusses 504 may be bolted together where they meet with high strength steel bolts at the top and bottom. Also, after the initial erection of the structural assembly 500, the vertical tension elements 402 are under required stress. FIG. 5 shows these vertical tension elements 402 as one single cable assembly. In another embodiment, the vertical tension elements 402 may be separate and not a single cable.

Figure 6:
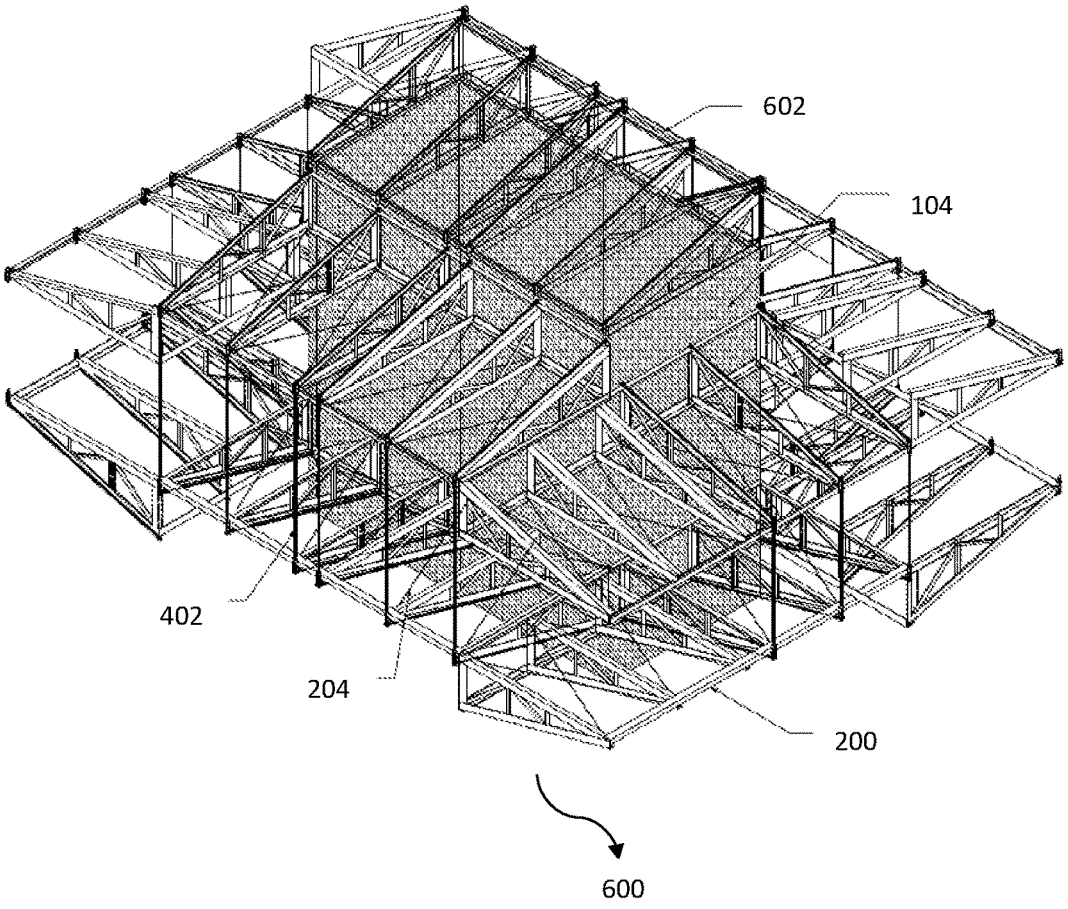
FIG. 6 shows an expanded structural assembly around a concrete anchor in accordance with an embodiment of the present invention.

FIG. 6 shows an enlargement of the building structural assembly around a single concrete anchor in a "simple" format, in accordance with an embodiment of the present invention. It shows a building structure 600 that is accomplished by adding six more structural compression modules 200 and eighteen vertical and diagonal tension members 402, 404, plus one structural compression module to form the roof 602 of the concrete anchor unit 104, according to an embodiment.

Further, according to the FIG. 6, the design of the building structure 600 results in a dwelling unit of 1,728 gross square feet of floor area, according to an embodiment. This is sufficient for a three bedroom dwelling.

Larger units may be assembled, preferably where structural compression modules 200 are configured in more complicated ways, such as wider bodies or multiple floors and/or additional concrete anchor units 104 are added.

It should be noted that the structures of embodiments of the present invention are independent of the type of foundation and can be placed anywhere there is solid bearing material that will support its weight. In an embodiment, the building structure 600 may be built upon a standard foundation, in many cases mandated by FEMA or local regulations. In another embodiment, the building structure 600 may be anchored to any solid substrate, such as a granite rock out cropping or some such other natural solid structure. In another embodiment, the building structure 600 may also be anchored on pile caps, new or existing. In yet another embodiment, auger holes can be drilled, the bottoms filled with concrete and the building structure 600 may be anchored to round concrete columns dropped into the holes.

Exemplary Variations of the Building Structure

Within the confines of the basic structural assembly, illustrated in FIG. 6, any variations of size and internal plan can be achieved. Some of the variations that can be achieved using only the three basic components; concrete anchor unit 104, structural compression module 200 and tension elements 304 are described herein.

External cladding added to the structural assembly provides for additional variations. It is assumed that other designs of claddings can be attached to the structural assembly in accordance with designer desires.

A simple variation that would allow a one bedroom unit, using two complete unique structural assemblies and one concrete anchor 104 is possible. The USA ("unique structural assemblies") connected to the short side of the CA ("concrete anchor") can be on either side, one being a mirror image variation of the other.

Three USA's may be around a single CA. This will result in what is known in real estate jargon as a "junior two". One standard size bedroom and one smaller room suitable for a home office or a small child's room.

A variation using five USA's and one CA is possible. This is one of the largest of the example "simple" variations and results in a standard three bedroom unit of 1,728 square feet.

"Complicated" variations where two USA's are joined face to face to form a larger peaked roof living area are possible. This results in either a large two and a half bedroom unit or a smaller three bedroom unit of 1,440, square feet of floor area.

The same "complicated" variation as as above with two USA's added to the rear of the CA and left without vertical wall cladding is possible. This will form a covered porch. Any USA can be left without vertical cladding to form a covered porch on any side of the unit. The covered porch can be enclosed with vertical wall panels. This will result in a large unit of 2,016 square feet that can be configured in many interior plans.

Another "complicated" variation that will result in a unit of 2,016 square feet as above with the opportunity for different interior floor plans is possible. With the configuration of two USA's on each of the long sides of the CA, the largest configuration with one single CA can be achieved. The unit will be comprised of nine compression modules and will have 2,592 square feet which allows a myriad of interior floor plans.

A configuration with two CA's, which in this first variation is smaller than the above larger variation with a single CA is possible. The variations with two CA's can result in a unit of 2,880 square feet within a total of 10 compression modules (not illustrated). This will allow many variations in floor plans conquerable to the dwelling units being constructed by the house building industry today.

The invention claimed is:

1. A structure comprising:

(a) one or more means for anchoring, the said anchoring means comprise an assembly of concrete panels, which form a habitable space;

(b) one or more structural compression modules attached to the one or more concrete panels and not having a foundation underneath, wherein one or more steel tension cables are fixed within the one or more structural compression modules, and wherein: (i) the structure is capable of withstanding hurricane force winds, (ii) the one or more steel tension cables transfer force to the one or more concrete panels (iii) the one or more means for anchoring form an enclosed habitable space having at least one opening and (iv) the structural compression modules form a one or more additional enclosed habitable spaces.

2. The structure of claim 1 wherein the concrete panels are attached to each other via steel clips.

3. The structure of claim 1 wherein the concrete panels are attached to each other via leveling jacks.

4. The structure of claim 1 wherein the one or more structural compression modules further comprises steel sections.

5. The structure of claim 4 wherein the steel sections comprise steel bars.

6. The structure of claim 4 wherein the steel sections are hollow.

7. The structure of claim 4 wherein the one or more steel tension cables are fixed to the steel sections.

8. The structure of claim 1 wherein the one or more steel tension cables are adjustably fixed within the one or more structural compression modules.

9. The structure of claim 1 wherein the structure is resistant to earthquake damage, tornado forces, fire, mud slides and storm surge.

10. A structure comprising:

(a) one or more means for anchoring, the said anchoring means comprise an assembly of concrete panels, which form an enclosed habitable space having at least one opening;

(b) one or more structural compression modules braced against the one or more concrete panels through one or more steel tension cables, wherein said cables are fixed within the one or more structural compression modules and not having a foundation underneath, and wherein: (i) the structure is capable of withstanding hurricane force winds, (ii) the one or more steel tension cables transfer force to the one or more concrete panels (iii) and the structural compression modules form a one or more additional enclosed habitable spaces.

* * * * *